US010596398B2

(12) United States Patent
Langbein et al.

(10) Patent No.: US 10,596,398 B2
(45) Date of Patent: Mar. 24, 2020

(54) SAFETY DEVICE

(71) Applicant: P-CRANE GLOBAL LIMITED, Wakefield (NZ)

(72) Inventors: Ross Langbein, Wakefield (NZ); Katrina Langbein, Wakefield (NZ)

(73) Assignee: P-CRANE GLOBAL LIMITED, Wakefield (NZ)

( * ) Notice: Subject to any disclaimer, the term of this patent is extended or adjusted under 35 U.S.C. 154(b) by 0 days.

(21) Appl. No.: 15/755,116

(22) PCT Filed: Sep. 22, 2016

(86) PCT No.: PCT/IB2016/055649
§ 371 (c)(1),
(2) Date: Feb. 26, 2018

(87) PCT Pub. No.: WO2017/055972
PCT Pub. Date: Apr. 6, 2017

(65) Prior Publication Data

US 2018/0243593 A1 Aug. 30, 2018

(30) Foreign Application Priority Data

Sep. 29, 2015 (NZ) ..... 712806

(51) Int. Cl.
*A62B 1/00* (2006.01)
*A62B 35/00* (2006.01)
(Continued)

(52) U.S. Cl.
CPC ..... *A62B 35/0068* (2013.01); *B66C 23/88* (2013.01); *B66F 17/006* (2013.01);
(Continued)

(58) Field of Classification Search
CPC ..... A47B 96/061; E04G 5/062; E04G 3/20; E04G 5/04
(Continued)

(56) References Cited

U.S. PATENT DOCUMENTS 3,844,377 A 10/1974 Wilkins
3,880,255 A 4/1975 Huntley
(Continued)

FOREIGN PATENT DOCUMENTS

DE 20201100564 8/2011
FR 2841887 1/2004
(Continued)

*Primary Examiner* — Steven M Marsh
(74) *Attorney, Agent, or Firm* — Scarinci Hollenbeck, LLC; Libby Babu Varghese

(57) ABSTRACT

A safety device including a boom with a primary end and a secondary end, where: —the primary end and secondary end are the opposite terminal ends of the boom; —the primary end is configured to be, releasably or permanently, attached to a mounting which includes a mounting joint which is a hinge joint; —the boom includes a base section, zero or one intermediate section and a load section connected together, in that order, by hinge joints, such that the safety device can extend from a mounting in a single plane, a movement plane, that lies parallel to the longitudinal axis of the boom, —the primary end is coterminous with an exposed end, a first base end, of the load section; —the load section includes a first load end and a second load end, where the first and second load ends are opposite terminal ends of the load section; —the secondary end is coterminous with the second load end; and the second load end includes a connection point, where the connection point is configured to releasably attach a user to the boom via a device with fall arrest capabilities, such that the connection point does not slide lengthwise along the load section.

24 Claims, 6 Drawing Sheets

(51) Int. Cl.

| | |
|---|---|
| ***E04G 3/32*** | (2006.01) |
| ***B66F 17/00*** | (2006.01) |
| ***E04G 5/00*** | (2006.01) |
| ***B66C 23/88*** | (2006.01) |
| ***E04G 21/32*** | (2006.01) |

(52) U.S. Cl.
CPC ..... *E04G 3/32* (2013.01); *E04G 5/001* (2013.01); *E04G 21/3204* (2013.01)

(58) Field of Classification Search
USPC ..... 248/235, 239, 240, 241; 182/153, 155
See application file for complete search history.

(56) References Cited

U.S. PATENT DOCUMENTS

| | | | | |
|---|---|---|---|---|
| 8,561,952 | B2 * | 10/2013 | Pfeiler | F16M 11/045 248/187.1 |
| 10,294,682 | B2 * | 5/2019 | Cockerell | E04G 21/3266 |
| 2003/0106742 | A1 | 6/2003 | Shechter | |
| 2008/0011920 | A1 * | 1/2008 | Sloan | A47B 43/003 248/235 |
| 2012/0186906 | A1 | 7/2012 | Chilton | |
| 2013/0292522 | A1 * | 11/2013 | Sears | A47B 21/0371 248/118 |
| 2014/0339019 | A1 * | 11/2014 | Hulett | E04G 3/20 182/113 |

FOREIGN PATENT DOCUMENTS

| | | |
|---|---|---|
| JP | H03216497 | 9/1991 |
| JP | H10167670 | 6/1998 |
| WO | WO 2009058071 | 5/2009 |

* cited by examiner

SAFETY DEVICE

TECHNICAL FIELD

The present invention is a safety device for workers operating at a height; more particularly a device that allows movement in three dimensions whilst arresting or controlling the descent rate of any fall.

BACKGROUND ART

Falls on worksites have increasingly come under scrutiny and various codes of practice and regulations have issued to make work at a height safer.

The installation of scaffolding and edge barriers provide a good solution but they take time and skill to erect which can make them impractical or simply too expensive for certain work. It is certainly not practical in many cases to install an emergency roof repair by erecting scaffolding first.

To provide a less permanent fall prevention system various mechanical work platform devices are available, and again these work well for the purpose they are designed for. Mechanical work platforms normally attach the worker to operating within the confines of the platform, and many lock the worker in place by restraint harnesses.

For larger buildings restraint or anchor points can be installed and a worker locks themselves to this anchor point and operates on the end of a cable. In some cases they may lock themselves to two separate spaced apart anchor points to reduce the likelihood of swinging into an obstacle if they fall. These solutions provide more freedom but, as the distance between the worker and the anchor point (s) increases, the cable may ride over objects. The cable riding over objects or surfaces may cause damage to the cable or jam up to prevent the worker moving. An overhead anchor point that moves a short distance along a rail can minimise the chances of the cable being damaged but to act as a fall preventer the movement is still limited to a short distance from the sliding anchor point. In some environments the anchor point may not easily slide along the rail and thus the movement can be restricted still further.

There are fall arresting devices that to allow a user to move around an extended area include a one piece boom which is pivotably attached to a structure and the connection point slides along the length of this boom. One risk with these devices is when a user falls the tether point can slide along the boom moving them further away from safety.

Identifying how or why a fall has occurred can be difficult and this can make reducing the chance of it reoccurring difficult.

It is an object of this invention to provide the user with a useful choice and where possible ameliorate one or more of the deficiencies highlighted above.

Any discussion of the prior art throughout the specification is not an admission that such prior art is widely known or forms part of the common general knowledge in the field.

DISCLOSURE OF INVENTION

The present invention provides a safety device including a boom with a primary end and a secondary end, where:

- the primary end and secondary end are the opposite terminal ends of the boom;
- the primary end is configured to be, releasably or permanently, attached to a mounting which includes a mounting joint which is a hinge joint;

- the boom includes a base section, zero or one intermediate section and a load section connected together, in that order, by hinge joints, such that the safety device can extend from a mounting in a single plane, a movement plane, that lies parallel to the longitudinal axis of the boom;
- the primary end is coterminous with an exposed end, a first base end, of the load section;
- the load section includes a first load end and a second load end, where the first and second load ends are opposite terminal ends of the load section;
- the secondary end is coterminous with the second load end; and
- the second load end includes a connection point, where the connection point is configured to releasably attach a user to the boom via a device with fall arrest capabilities, such that the connection point does not slide lengthwise along the load section. Preferably the connection point is configured to limit the amount a user connected to the connection point can slide along the length of the load section.

Preferably the boom and the mounting are releasably connected by a linking section. Preferably this linking section incorporates a quick release/engaging section. In an alternative preferred form the linking section is a permanent link between the boom and the mounting section.

The present invention also provides a safety device including a boom with a primary end and a secondary end, where:

- the primary end and secondary end are the opposite terminal ends of the boom;
- the primary end is, releasably or permanently, attached to a mounting by a mounting joint which is a hinge joint;
- the boom includes a base section, zero or one intermediate section and a load section connected together, in that order, by hinge joints, such that the safety device can extend from a mounting in a single plane, a movement plane, that lies parallel to the longitudinal axis of the boom;
- the primary end is coterminous with an exposed end, a first base end, of the load section;
- the load section includes a first load end and a second load end, where the first and second load ends are opposite terminal ends of the load section;
- the secondary end is coterminous with the second load end; and
- the second load end includes a connection point, where the connection point is configured to releasably attach a user to the boom via a device with fall arrest capabilities, such that the connection point does not slide lengthwise along the load section.

Preferably the connection point is configured to limit the amount a user connected to the connection point can slide along the length of the load section. Preferably the device with fall arrest capabilities is a self-retracting lanyard or lifeline with fall arrest capabilities.

Preferably in the joints allow a pivoting action only when a force above a preset minimum is applied. In a preferred form the joint operates as if it were, or contained, a bingham plastic or psuedoplastic.

Preferably the hinge joints and mounting joint are permanently or releasably lockable joints. Preferably the lockable joints have two states, a locked state and a free state where in the locked state the lockable joint forms a rigid connection and in the free state the lockable joint forms a pivotable connection. Preferably the lockable joint automatically moves to the locked state when a user attached to the safety device falls. Preferably the user is attached to the safety device by a self-retracting lanyard or lifeline with fall arrest capabilities. Preferably when a user falls and activates the self-arrest characteristics of the device with fall arrest capabilities (preferably a self-retracting lanyard or lifeline) then the lockable joints move into the locked position.

Preferably the base section includes the first base end and a second base end which are opposite terminal ends of the base section where the first base end is coterminous with the primary end of the boom. Preferably, where present, the intermediate section includes a first intermediate end and a second intermediate end which are opposite terminal ends of the intermediate section. Preferably the intermediate section, where present, includes a plurality of serially pivotably connected intermediate sub-sections.

Preferably the mounting incorporates a mast including a mast end, a terminal end of the mast located above the movement plane, and a bracing member where the bracing member is pivotably attached to the mast above the base section and a connection point at or close to the second base end.

Preferably the base section is attached to a bracing section and a primary guide, where:

- the primary guide includes a first guide terminal end and a second guide terminal end, which are opposite terminal ends of the primary guide;
- the bracing section includes a first brace end and a second brace end;
- each section includes a longitudinal axis;
- the guide section is attached to the base section close to or at the first base end with the axis of the base section and the guide section perpendicular;
- the first brace end is attached to base section;
- the second brace end is attached to the primary guide; and
- the longitudinal axes of the sections form a right angle triangle, such that the primary guide is configured to be releasably or permanently engaged with a mounting pin or mounting to form the mounting joint.

Preferably each hinge joint, and the mounting joint, allows at least 360° movement around that joint. Preferably the mounting joint allows up to 180° movement.

Preferably at least one section is an elongate member such as a beam or truss. Preferably each section is of lightweight construction. Preferably at least one section is constructed of organic or inorganic polymers, plastic composite, fibre reinforced plastic composite, metal, wood or plant material, or a combination of one or more of these materials.

Preferably the boom includes a video monitoring devices configured to monitor a user of the safety device. Preferably the video monitoring device records a continuous loop, continuously or when a user falls. Preferably, when recording a continuous loop the video monitoring device stops recording at a pre-set point if a fall is detected. Preferably the boom includes one or more light sources and/or one or more sensors. Preferably the one or more sensors are selected from the group consisting of strain sensors, temperature sensors, pressure sensors, light sensors, movement detectors (infrared, microwave, ultrasonic or a combination), micro switches, load sensors, distance sensor, orientation sensor, concentration sensors (for chemical contaminants). Preferably the video monitoring device is attached to a connection face of the load section. Preferably the connection face is the lowermost face of the boom.

Preferably one or more sensors send a sensor output signal representative of a parameter they measure to a monitoring device, where the monitoring device generates a monitoring output based on this. Preferably the monitoring device logs the sensor output signal at regular intervals. Preferably if the sensor output signal exceeds a predetermined level a warning is triggered. Preferably this warning results in an audio and/or tactile and/or visual alert perceivable to the user being generated.

Preferably each of the sections is from 0.7 to 5 m in length, though in a highly preferred form they are from 0.7 m to 3 m. Preferably the length of each section is independent of the length of any other section.

In one preferred form the safety device is incorporated into, or releasably attached to a mobile structure or a permanent structure. Preferably the connection to the structure is made through a mast. Preferably the mast is telescopic and configured to be extendible from a collapsed form to an extended form and vice versa, where the collapsed form is shorter than the extended form.

BRIEF DESCRIPTION OF DRAWINGS

By way of example only, a preferred embodiment of the present invention is described in detail below with reference to the accompanying drawings, in which.

DEFINITIONS

Cherry picker a hydraulic crane with a railed/fenced platform at the end for raising and lowering people, for instance to work on overhead cables.

Hinge joint where the term hinge or hinge joint is used it means that the joint allows rotation about a single axis, limiting the movement to a single plane essentially perpendicular to that axis, it does not limit the amount of rotation about that axis or in that plane.

Pivot where the term pivot or pivotable is used it is intended to mean the action possible from a hinge joint, that is a rotation about an axis in a single plane, with no limit to the amount of rotation about that axis.

First Mode for Carrying Out the Invention

Figure 1:
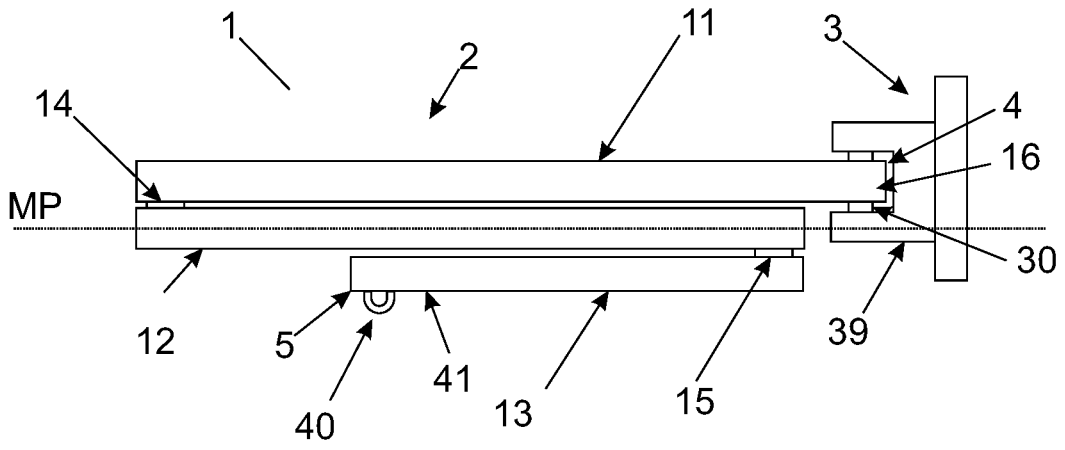
FIG. 1 is a side view of the safety device mounted to a bracket.
Figure 2:
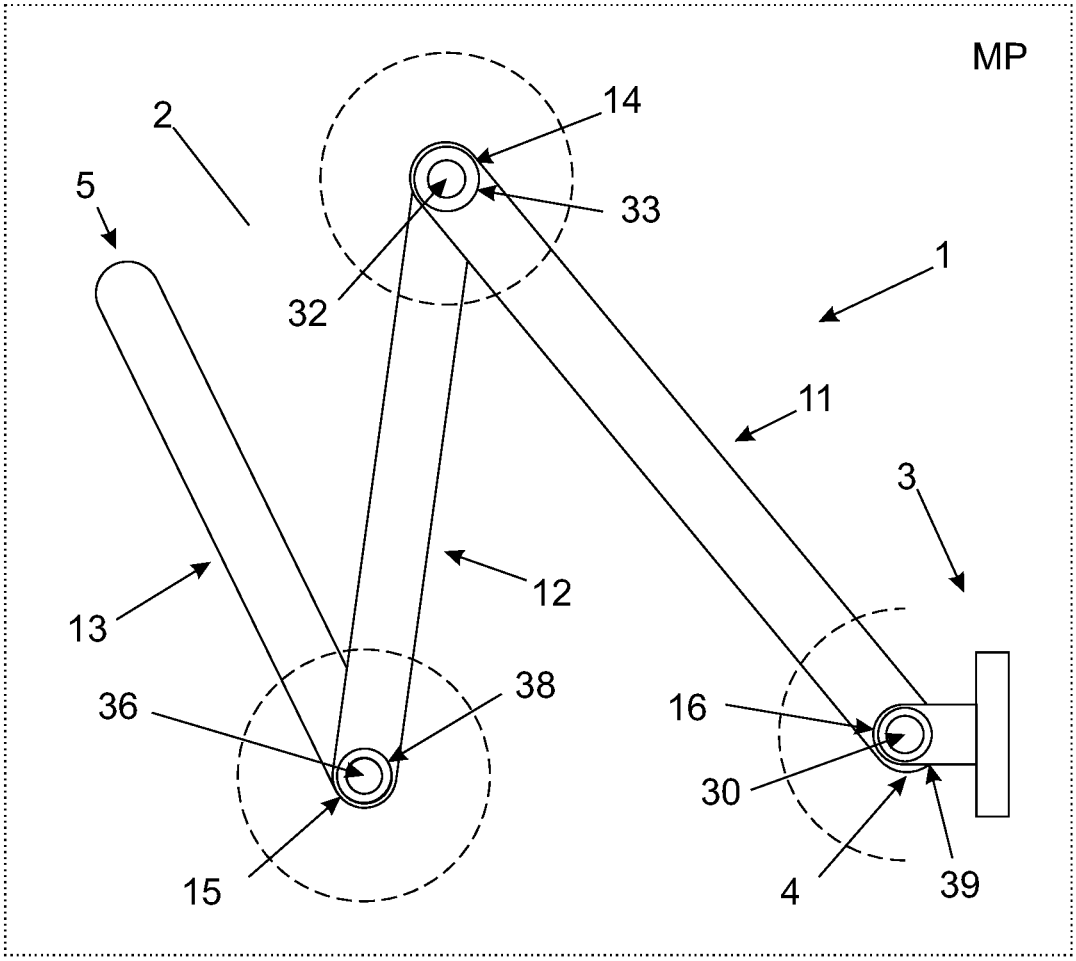
FIG. 2 is a plan view of the safety device with each of the hinged sections moved so they are visible.

Referring to FIG. 1 and FIG. 2 a first embodiment of a safety device (1) including a boom (2) and an optional mounting (3) is shown.

The boom (2) includes a primary end (4), a secondary end (5) and three sections (11,12,13), a base section (11), an intermediate section (12) and a load section (13). Where the primary end (4) is one terminal end of the boom (2) and the secondary end (5) is the opposite terminal end of the boom (2). The primary end (4) is coterminous with one terminal end of the base section (11). The secondary end (5) is coterminous with one terminal end of the load section (13).

Referring to any one of FIG. 1 and FIG. 2, each section (11,12,13) is an elongate member such as a beam or truss connected to the immediately adjacent section (11,12,13) by a hinge joint (14,15) The base section (11) Is connected to the intermediate section (12) by an alpha hinge joint (14) and the intermediate section (12) is connected to the load section (13) by a beta hinge joint (15). The primary end (4) is attached to the mounting (3) by a mounting joint (16), in this first mode the mounting joint (16) is also hinge joint. The longitudinal axis of the base section (11) lies essentially parallel to the longitudinal axis of the load section (13), and in this variant the intermediate section is also shown with a longitudinal axis parallel to both the base section (11) and the load section (13). This alignment of the longitudinal axes means that the boom (2) can move and extend in only a single plane, the movement plane (MP) (shown as a dotted line).

As shown in FIG. 1 the base section (11) lies above the intermediate section (12) which in turn lies above the load section (13) this allows the alpha and beta hinge joints (14,15) to provide up to 360° of rotation (shown as dashed lines in FIG. 2) in the movement plane (MP). The mounting joint (15) is shown in dashed lines (FIG. 2) as having about 180° of rotation in the movement plane (MP), but, this is dependent on the location of the mounting joint (16) and it could be anything up to 360°.

Figure 3:
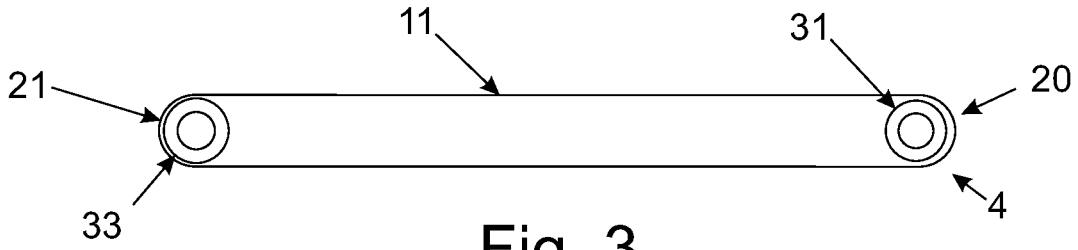
FIG. 3 is a plan view of the base section separated from the safety device.
Figure 4:
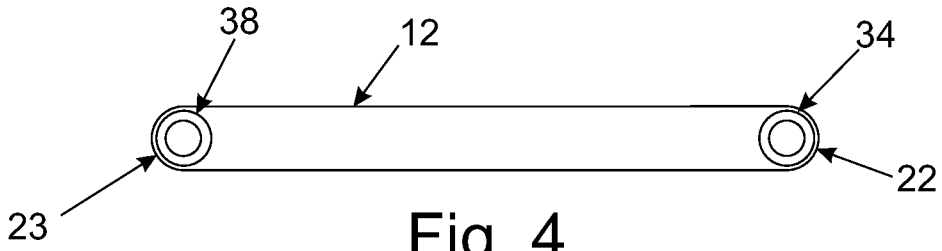
FIG. 4 is a plan view of the intermediate section separated from the safety device.
Figure 5:
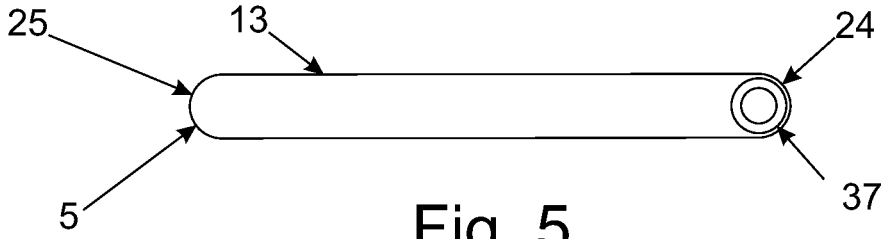
FIG. 5 is a plan view of the load section separated from the safety device.

Referring to FIG. 3 to FIG. 5 the sections (11,12,13) are shown separately in plan view for clarity. Each of the sections needs to be rigid and light, this may mean that they are solid, hollow or a form of truss. The most suitable materials for each section (11,12,13) is expected to be a metal (titanium, aluminium, steel, alloys) or a composite material (glass or carbon reinforced plastic for example) though combinations of these materials and others in a specific form may also be used. The boom (2) needs to resist significant deflection to provide the required support for a user. The term significant deflection is intended to mean the deflection is limited to no more than that allowed under the relevant safety regulations, standards or laws in force in that country/state/county/region, or the deflection is no more than that required to protect a user who has fallen.

In FIG. 3 the base section (11) including a first base end (20) and a second base end (21) is shown. The first and second base ends (20,21) are opposite terminal ends of the load section (11). The first base end (20) is coterminous with the primary end (4).

In FIG. 4 the intermediate section (12) including a first intermediate end (22) and a second intermediate end (23) is shown. The first and second intermediate ends (22,23) are opposite terminal ends of the intermediate section (12).

In FIG. 5 the load section (13) including a first load end (24) and a second load end (25) is shown. The first and second load ends (24,25) are opposite terminal ends of the base section (13). The second load end (25) is coterminous with the secondary end (5).

Referring to any one of FIGS. 1 to 5:—

The mounting joint (16) includes a mounting pin (30) and a mounting pin guide (31);

The alpha hinge joint (14) includes a base pin (32) and two base pin guides (33,34), a first base pin guide (33) and a second base pin guide (34); and The beta hinge joint (15) includes a load pin (36) and two load pin guides (37,38), a first load pin guide (37) and a second load pin guide (38); where The first base pin guide (33) is located close to or at the second base end (21);

The second base pin guide (34) is located at or close to the first intermediate end (22);

The first load pin guide (37) is located close to or at the first load end (24); and The second load pin guide (38) is located close to or at the second intermediate end (23).

The pins (30,32,36) are shafts that are engaged with the complementary pin guides (31,33,34,37,38) about which the attached section (11,12,13) can pivot. The pin guides (31, 33,34,37,38) can be, or can include, bushes and/or bearings of known type (e.g. taper roller bearings, roller bearings, ball bearings, thrust bearings, plain bearings, fluid or possibly magnetic bearings). In use under normal conditions the pins (30.32.36) cannot slide along the length of the complementary guides (31,33,34,37,38), the pins may be pressed into bearings making up the guide (31,33,34,37,38), the pins (30,32,36) may include apertures that are engaged with a cotter pin, a split pin. a clevis pin, a roll pin, a taper pin, a dowel pin and/or channels engaged with retaining rings, or anything similar. The pins (30,32,36) may also be T shaped, thus mechanically limited in differential longitudinal movement in the complementary guide (31,33,34,37,38).

The alpha hinge joint (14), beta hinge joint (15) and mounting joint (16) move smoothly once a predetermined minimum force is applied but below this minimum value the joint (14,15,16) in question does not move. This may require preload is applied to some of the components (bearings for example) used for these joints (14,15,16), or it could involve the use of a non-newtonian fluid, a pseudoplastic or bingham plastic as part of the joint (14,15,16) for example.

As shown in FIG. 1 the mounting includes a U-shaped bracket (39) and the mounting pin (30) extends between the two arms of the 'U'. The longitudinal axis of the 'U' is approximately aligned with the longitudinal axis of the base section (11).

Referring to FIG. 1 a connection point (40) is shown extending from a connection face (41) of the load section (13) close to the secondary end (5), in this variant the connection point (40) is a ring of rigid material rigidly attached to the connection face (41). The connection face (41) in this variant is the exposed lowermost face of the load section (13).

Second (Best) Mode for Carrying Out the Invention

Figure 6:
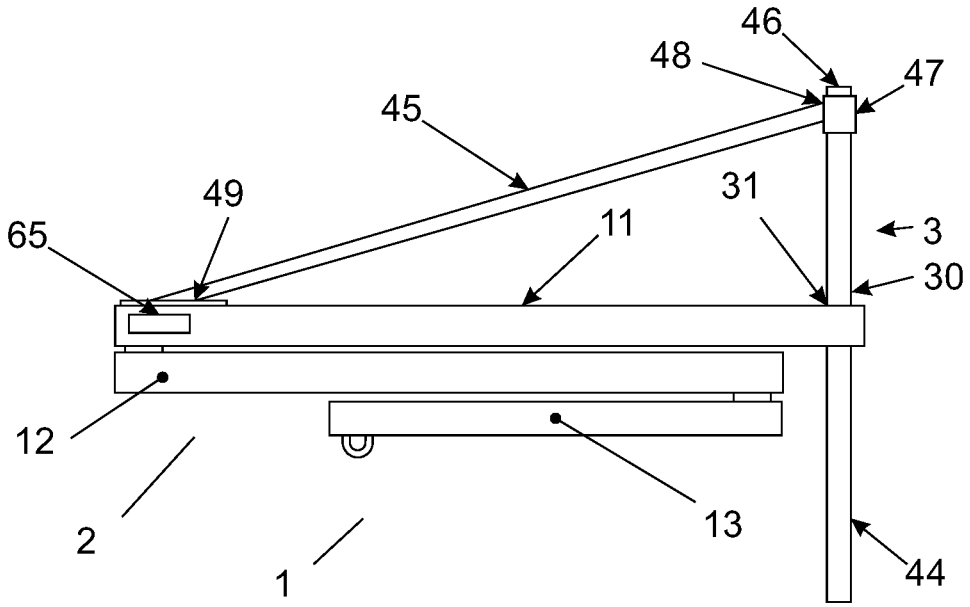
FIG. 6 is a side view of a second embodiment including a mast.

Referring to FIG. 6 a second embodiment of the safety device (1) is shown, in this variant the mounting (3) includes a mast (44) and a bracing member (45). The mast (44) is a shaft or tube which includes the mounting pin (30) that extends through the mounting pin guide (31) terminating at a mast end (46). The bracing member (45) includes a bracing guide (47) located at a first brace end (48) that engages with the mast (44) above the mounting pin (30) and below or at the mast end (46). The first brace end (48) is one terminal end of the bracing member (45). The bracing member (45) extends from the mast (44) to a point, a brace connection point (49), along the length of the base section (11). The longitudinal axis of the base section (11), mast (44) and bracing member (45) form a right angle triangle, this provides additional support for the base section (11) whilst still allowing rotation about the mounting pin (30).

Figure 7:
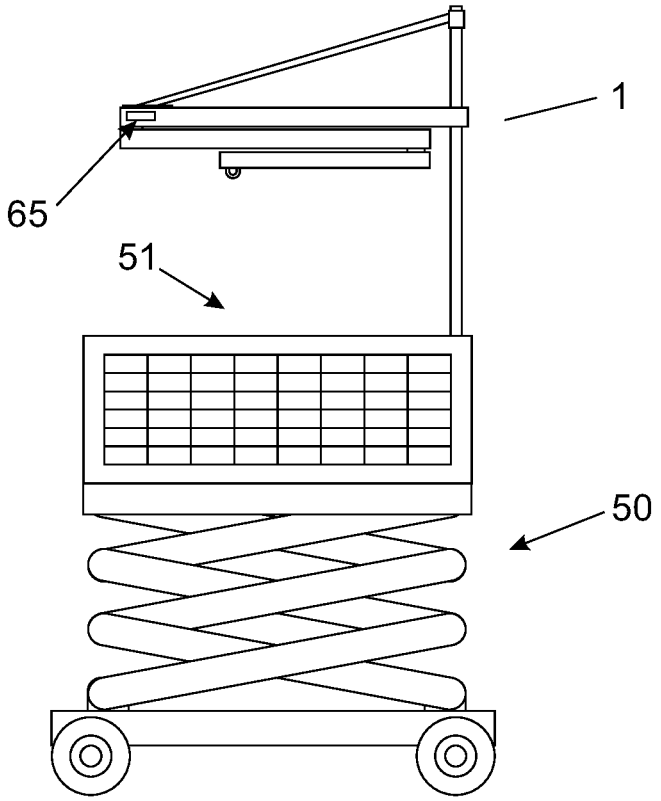
FIG. 7 is a pictorial view of the second embodiment attached to an elevating platform.

Referring to FIG. 7 the second embodiment safety device (1) is shown attached to an elevating platform (50), to minimise the tipping moment applied to the elevating platform (50) the safety device (1) is shown extending over the work area (51) of the elevating platform (50). Small versions of the safety device may be used instead of rails or slide connections for safety harnesses.

Figure 8:
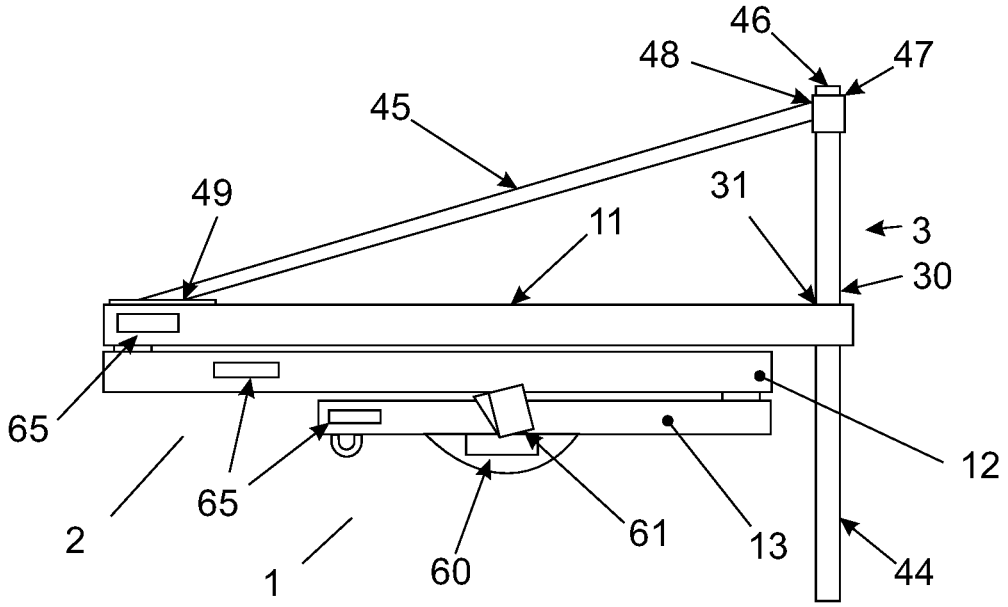
FIG. 8 is a side view of a third embodiment with video monitoring equipment and optional lighting units.

Referring to FIG. 8 a third embodiment including a video monitoring device (60) is shown, the video monitoring device (60) is a video camera or similar device that is able to record moving images. The video monitoring device (60) is attached to the connection face (41) such that it can monitor a user of the safety device (1). The video monitoring device (60) may operate continuously, record only when a fall occurs, record a loop of video of predetermined length, or any other variant or combination of these. The intention is to record any falls that occur to allow the reasons to be identified and where appropriate ameliorated. Optional lighting units (61) are shown in place these are provided to illuminate the work area and/or improve the quality of any video footage recorded by the video monitoring device (60). The optional lighting units (61) are most likely to include Light Emitting Diodes (LED) light sources for robustness.

In use a user wearing a harness of known type is attached to the connection point (40) by a self-retracting lanyard or lifeline with fall arrest capabilities of known type, or any similar device with fall arrest capabilities (inertia rope lock, inertia reel, etc.). If the user falls the fall arrest device will limit the distance fallen, and if required the safety device (1) will further limit the fall. A self-retracting lanyard or lifeline with fall arrest capabilities is similar to an inertia reel seat belt in that it allows the belt to extend when the force applied is not a force impulse above a certain pre-set level, but above this pre-set force impulse threshold it locks, permanently or releasably depending on the characteristics of the device. The self-retracting lanyard or lifeline with fall arrest capabilities allows a user to operate vertically separated from the movement plane (MP). In some cases the extended length of the self-retracting lanyard or lifeline with fall arrest capabilities may be limited so that if the user falls with it fully extended the chance of a dangerous pendulum motion is minimised.

Figure 9:
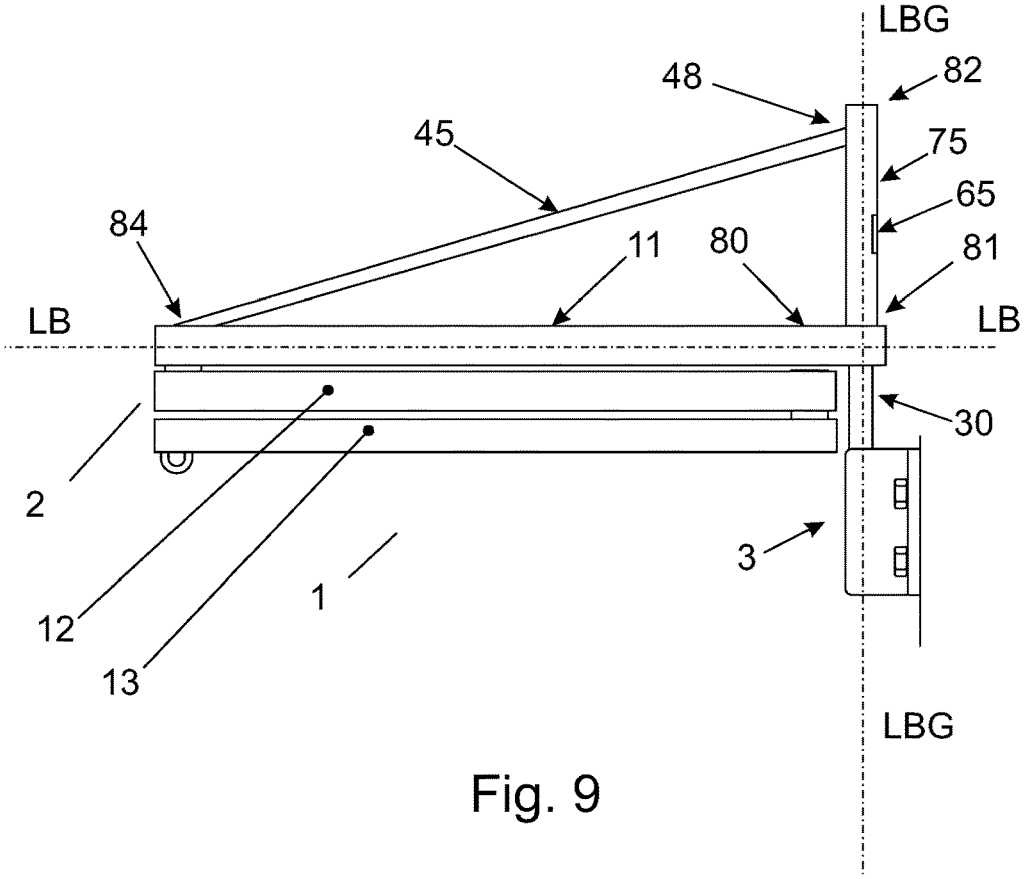
FIG. 9 is a side view of a fourth embodiment of the safety device.

Referring to FIG. 9 a fourth embodiment of the safety device (1) is shown, in this variant the safety device (1) does not include the mounting (3), instead it is configured to engage with a mounting pin (30) which is part of a separate mounting (3). Similar to the second embodiment, in the fourth embodiment the base section (11) includes a bracing member (45) and a primary guide (75). The safety device (1) in this embodiment may be permanently or releasably engaged with the mounting pin (30)

The primary guide (75) is a tube (with or without a blind terminal end) extending away from a first base surface (80) of the first base end (20). The first base surface (80) is the uppermost surface of the base section (11). The primary guide (75) includes a first guide terminal end (81) and a second guide terminal end (82), with the first guide terminal end (81) being coterminous with the base section (11). The primary guide (75) may include, operate as, or be coterminous with, a bracing guide (47) (not shown).

The bracing member (45) includes a first brace end (48) and a second brace end (84) which are opposite terminal ends of the bracing member (45) The first brace end (48) is attached to the primary guide (75) and the second brace end (84) is attached to the base section (11). The longitudinal axes of the base section (11) and the bracing member (45), labelled LB and LBG respectively, are perpendicular, so that the axes of the base section (11), primary guide (75) and bracing member (45) form a right angle triangle. This triangular bracing provides additional support for the base section (11) whilst still allowing rotation of the safety device (1) about the mounting pin (30).

As shown the mounting pin (30) does not extend beyond the end of the bracing guide (47), in other variants it may. The primary guide (75) and mounting pin (45) are connected such that the primary guide (75) can rotate around the longitudinal axis of the mounting pin (30), to do this one or more bearings or bushes of known types can be used (alone or in combination). If the second guide terminal end (82) is coterminous with a terminal end of the mounting pin (30) then bushes, bearings or low friction materials or devices may be installed to maintain the desired rotational freedom between the two.

Figure 10:
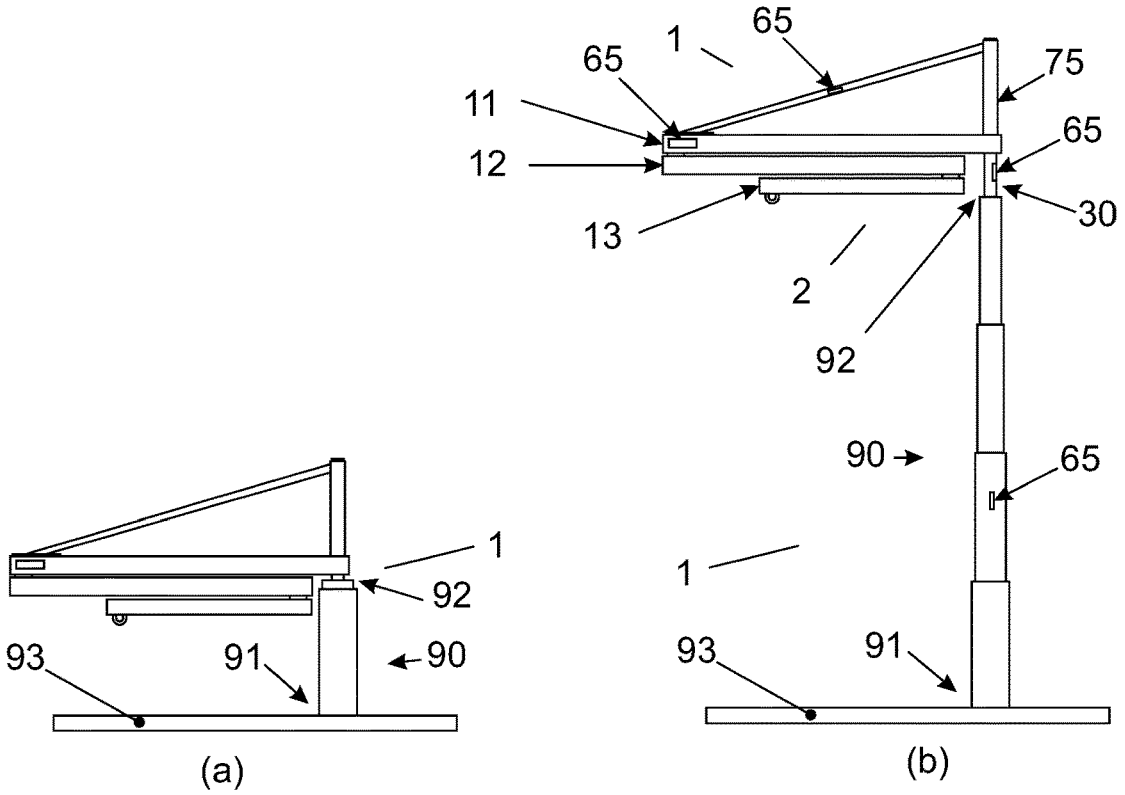
FIG. 10 is a side view of a fifth embodiment with a telescoping mount, shown in un-extended (a) and extended (b) forms.

Referring to FIG. 10 a fifth embodiment is shown, in this embodiment the mounting (3) includes an extendible section (90) that telescopes to change in length. This extendible section (90) is shown compressed (un-extended) in FIG. 10(*a*) and fully extended in FIG. 10(*b*). The extendible section (90) includes an alpha terminal end (91) and a beta terminal end (92), which are the opposite terminal ends of the extendible section (90). The beta terminal end (92) is coterminous with the mounting pin (30) and the alpha terminal end (91) is attached to, or forms part of, a support unit (93). The support unit (93) provides a support base for the safety device (1), and it may include additional anchoring or load spreading devices such as legs, screw anchors, guy wires, etc. (not shown, but well known). Though not shown the fifth embodiment can be part of a mobile unit such as a trailer, mounted to a utility vehicle or mounted onto a truck bed.

Figure 11:
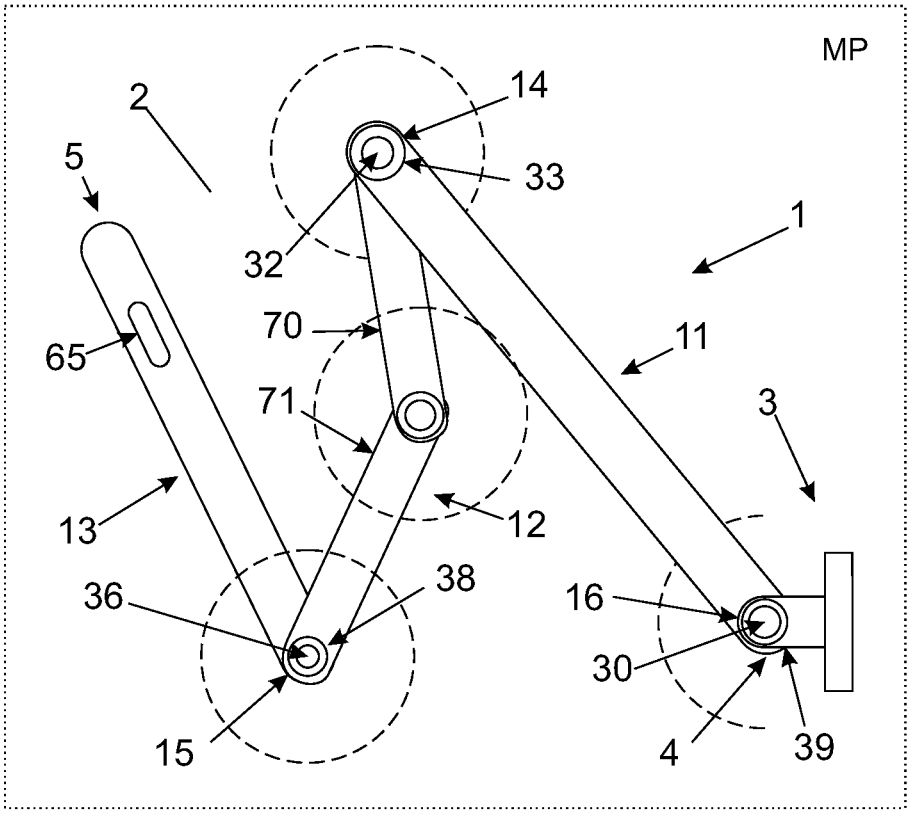
FIG. 11 is a plan view of a variant with a plurality of intermediate sub-sections present.
Figure 12:
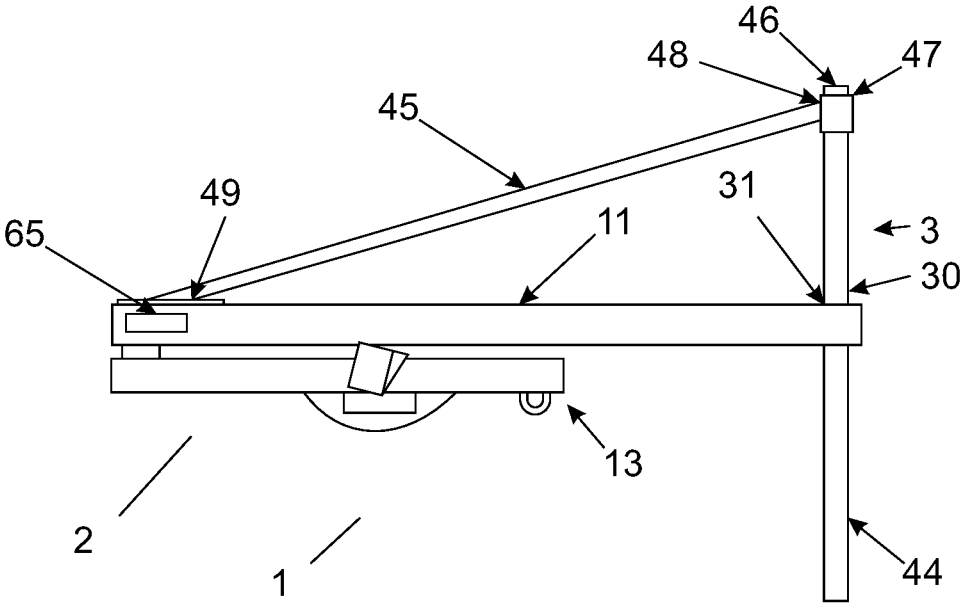
FIG. 12 is a side view of a variant with no intermediate section present.

Though described with reference to a load section (13) an intermediate section (12) and a base section (11), the intermediate section (12) of any embodiment or variant may consist of a plurality of intermediate sub-sections (70,71) (as shown in FIG. 11) or the boom (2), may consist only of a load section (13) directly attached to a base section (11) as shown in FIG. 12). The number of intermediate sub-sections (70,71) depends on the requirements of the specific site, but, the expected number of intermediate sub-sections (70,71) is likely to be in the range of 2 to 6.

Figure 13:
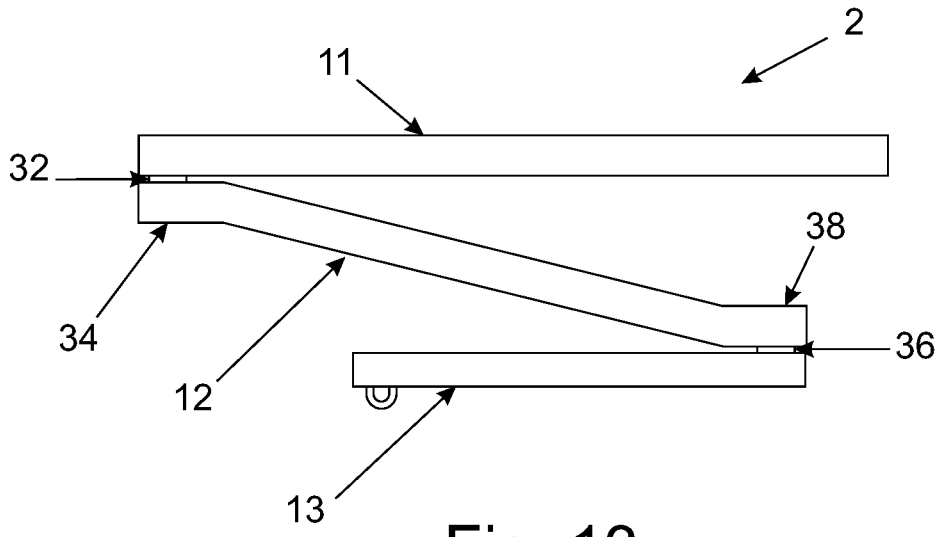
FIG. 13 is a side view of a variant with a cranked intermediate section.

A further variant is shown in FIG. 13, where a cranked, the second base pin guide (34) and the second load pin guide (38) are vertically separated but have parallel longitudinal axes. This allows a vertical height difference to be incorporated into the boom (2) which can be useful in some configurations. For example where the self-retracting lanyard or lifeline with fall arrest capabilities is required to allow only a minimal spacing between the user and the boom, but, the safety device can only be mounted at a height which would exceed this spacing. Though only the intermediate section (12) none, any or all, of the sections (11,112,13) can also be cranked.

Figure 14:
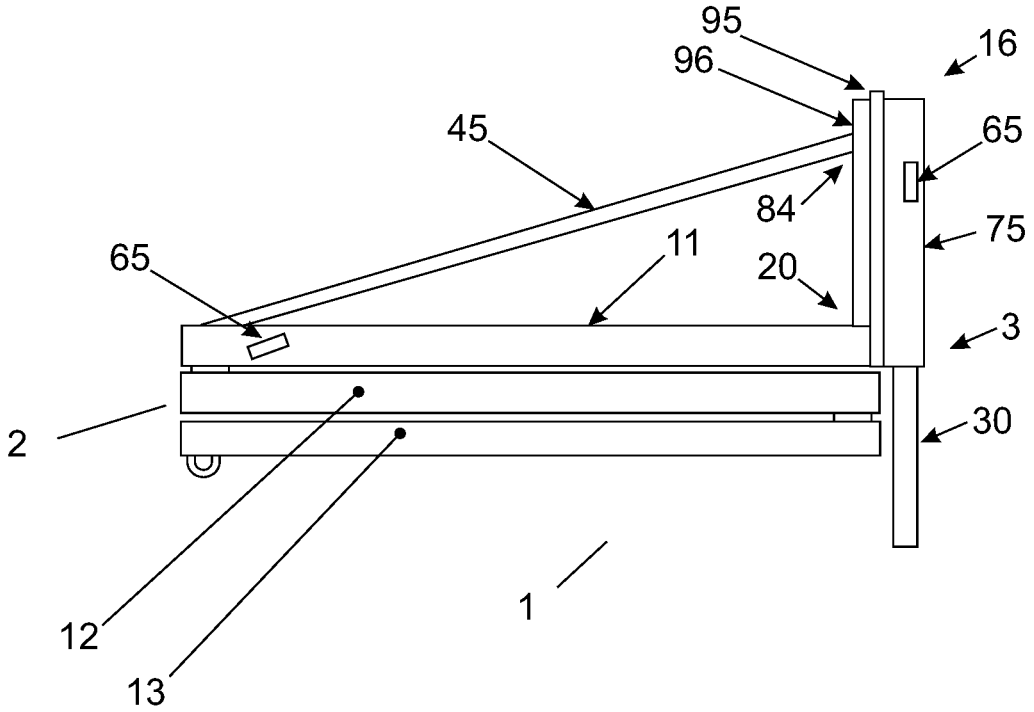
FIG. 14 is a side view of a sixth embodiment where the safety device incorporates a linking section to releasably attach the safety device to a mounting joint which is part of a mount.

A further sixth embodiment is shown in FIG. 14, in this variant the safety device (1) includes only the boom (2) which is releasably attached to a mounting (3) by a linking section (95). In this embodiment the base section (11) includes the bracing member (45) and an upright (96). Where the upright (96) links the first brace end (84) and the first base end (20). The longitudinal axes of the linking section (95), base section (11) and upright (96) forming a right angle triangle.

The mounting (3) includes a primary guide (75) and a mounting pin (30) which form a hinge joint. The linking section (95) attaches the upright (96) to a primary guide (75). The linking section (95) can be as simple as two plates bolted together, a device that allows the two to be releasably attached (for example a device similar to a quick hitch device or system for excavator buckets), a quick release mounting system or device for bulldozer blades, a quick release device or system for cranes, mounting hooks that engage with complementary slots, magnetic clamps, welds, rivets, keys in keyways, or a combination of two or more of these.

It should be noted that any of the variants or embodiments may releasably attach the boom (2) to the mounting (3) directly by a linking section (95), or via a linking section (95) incorporated into the mounting joint (16).

It is intended that in some or all of the variants or embodiments (see any of FIG. 1 to FIG. 13) the pins (30,32,36) and/or guides (31,33,34,37,38,47,75), or the pins (30,32,36) alone, incorporate features that, when exposed to a force impulse associated with a user falling, lock the alpha hinge joint (14), beta hinge joint (15) and mounting joint (16) so that they no longer act as hinges. When in this locked position the boom (2) is essentially a rigid construct, this minimises the opportunity for a user to swing from the end of the boom (2). This locking feature may be able to be disengaged for each specific joint (14,15,16) for recovery of the user, alternatively this locking feature may automatically reset if the force impulse is below a certain level to allow self-recovery (this may be limited to minor falls), or in a further alternative form the locking feature once engaged may permanently lock the boom (2). Alternatively the mounting, alpha hinge and beta hinge joints (16,14,15) are a form of locking hinge joint, where if the load is below a certain level the hinge does not pivot, or if the hinge has a certain level of off-plane (the movement plane) strain applied it does not move. Examples of these locking hinge joints can be found in U.S. Pat. No. 5,586,363, where a plunger could be preset to engage/disengage if the strain or angle on a joint (14,15,16) was above a certain level.

In some variants or embodiments (see any of FIG. 6 to FIG. 12, noting that not all of the monitored items are present or numbered in all of the drawings) one or more of the sections (11,12,13), pins (30,32,36), guides (31,33,34,37,38), mast (44), bracing member (45), bracing guide (47), primary guide (75), mounting (3) or other part of the safety device (1) may include one or more monitoring devices (65) (see FIG. 6 for example). The monitoring device (65) could measure temperature, strain, moisture level, chemical contaminant level or a combination of these so that when a component is exposed to a condition likely to affect its integrity it can issue an alert that this has happened.

In alternative variants the mounting joint (16) may be able to pivot up or down in addition to the hinge action; this pivot action will allow the boom (2) to align with the slope of a roof, if it has this ability then it will be able to have the pivot action locked off at a specific angle when a user is attached.

Though described as different variants, the mast (44), bracing member (45), video monitoring device (60), lighting unit (61), monitoring devices (65), intermediate sub-sections and intermediate section (12) are optional and can be incorporated into any variant. It should be understood that various components of each embodiment or variant can be combined whilst not departing from the inventive concept.

The safety device (1) can be permanently attached to a building, attached to a mobile structure, for example truck, hydraulic truck or wagon mounted load lifter, cherry picker, mobile elevated platform, mobile scissor lift, basket crane, boom lift or knuckleboom crane. Alternatively the mounting (3) or mounting pin (30) may be permanently attached to a mobile structure and the safety device releasably attached or engaged with the mounting pin (30) or mounting (3).

As will be understood the boom (2) allows the user to move in a 2D-Plane and the fall arrest device allows the user to move above and below that plane unless their vertical velocity exceeds a predetermined value.

KEY

1. Safety device;
2. Boom;
3. Mounting;
4. Primary end;
5. Secondary end;
11. base section;
12. intermediate section;
13. load section;
14. alpha hinge joint;
15. beta hinge joint;
16. mounting joint;
20. first base end (includes part of mounting joint or is closest to the mounting);
21. second base end (includes part of alpha hinge);
22. first intermediate end (includes part of alpha hinge);
23. second intermediate end (includes part of beta hinge);
24. first load end (includes part of beta hinge);
25. second load end (coterminous with secondary end);
30. mounting pin;
31. mounting pin guide;
32. base pin;
33. first base pin guide;
34. second base pin guide;
36. load pin;
37. first load pin guide;
38. second load pin guide;
39. U shaped bracket (mounting);
40. connection point (may be a loop that allows a limited amount of sliding movement along the load section to occur);
41. connection face;
44. mast;
45. bracing member;
46. mast end;
47. bracing guide;
48. first brace end;
49. brace connection point;
50. elevating platform;
51. work area;
60. video monitoring device;
61. lighting unit;
65. monitoring device;
70. intermediate sub-section;

71. intermediate sub-section;
75. primary guide;
80. first base surface;
81. first guide terminal end;
82. second guide terminal end;
84. second brace end;
90. extendible section;
91. alpha terminal end;
92. beta terminal end;
93. support unit;
95. linking section;
96. upright;
97.
LB Longitudinal axis of the base section;
LBG Longitudinal axis of the bracing guide;

The invention claimed is:

1. A safety device including a boom with a primary end and a secondary end, where:
- the primary end and secondary end are opposite terminal ends of the boom;
- the primary end is configured to be, releasably or permanently, attached to a mounting which includes a mounting joint which is a hinge joint;
- the boom includes a base section, zero or one intermediate section and a load section connected together, in that order, by hinge joints, such that the safety device can extend from a mounting in a single plane, a movement plane, that lies parallel to a longitudinal axis of the boom,
- the primary end is coterminous with an exposed end, a first base end, of the load section;
- the load section includes a first load end and a second load end, where the first and second load ends are opposite terminal ends of the load section;
- the secondary end is coterminous with the second load end; and
- the second load end includes a connection point, where the connection point is configured to releasably attach a user to the boom via a device with fall arrest capabilities, such that the connection point does not slide lengthwise along the load section; wherein all joints are lockable joints which have two states, a locked state and a free state, where in the locked state the lockable joint forms a rigid connection and in the free state the lockable joint forms a pivotable connection; such that each lockable joint automatically moves to the locked state when a user attached to the safety device falls and activates the self-arrest characteristics of the device with fall arrest capabilities.

2. The safety device as claimed in claim 1, wherein at least one of the joints allows a pivoting action only when a force above a preset minimum is applied.

3. The safety device as claimed in claim 1, wherein at least one of the joints operates as if it were, or contained, a bingham plastic or psuedoplastic.

4. The safety device as claimed in claim 1, wherein the at least one of the joints is a permanently or releasably lockable joint.

5. The safety device as claimed in claim 1, wherein the base section includes the first base end and a second base end which are opposite terminal ends of the base section.

6. The safety device as claimed in claim 1, wherein there is one intermediate section which includes a first intermediate end and a second intermediate end which are opposite terminal ends of said intermediate section.

7. The safety device as claimed in claim 6, wherein the intermediate section, includes a plurality of serially pivotably connected intermediate sub-sections.

8. The safety device as claimed in claim 5, wherein the mounting incorporates a mast including a mast end, a terminal end of the mast located above the movement plane, and a bracing member where the bracing member is pivotably attached to the mast above the base section and a connection point at or close to the second base end.

9. The safety device as claimed in claim 1, wherein the base section is attached to a bracing section and a primary guide, such that:
- the primary guide includes a first guide terminal end and a second guide terminal end, which are opposite terminal ends of the primary guide;
- the bracing section includes a first brace end and a second brace end;
- each section includes a longitudinal axis;
- the guide section is attached to the base section close to or at the first base end with the axis of the base section and the guide section perpendicular;
- the first brace end is attached to base section;
- the second brace end is attached to the primary guide; and
- the longitudinal axes of the sections form a right angle triangle, where the primary guide is configured to be releasably or permanently engaged with a mounting pin or mounting to form the mounting joint.

10. The safety device as claimed in claim 1, wherein each hinge joint, and the mounting joint, allows at least 360° movement around that joint.

11. The safety device as claimed in claim 1, wherein the boom includes at least one video monitoring device configured to monitor the user of the safety device.

12. The safety device as claimed in claim 11, wherein the at least one video monitoring device records a continuous loop, continuously or only when a user falls.

13. The safety device as claimed in claim 1, wherein the boom includes one or more light sources and/or one or more sensors.

14. The safety device as claimed in claim 13, wherein the boom includes one or more sensors such that each sensor present is independently selected from the group consisting of strain sensors, temperature sensors, pressure sensors, light sensors, movement detectors (infrared, microwave, ultrasonic or a combination), micro switches, load sensors, distance sensor, orientation sensor, concentration sensors (for chemical contaminants).

15. The safety device as claimed in claim 11, wherein at least one video monitoring device is attached to a connection face of the load section, where said connection face is the lowermost face of the boom.

16. The safety device as claimed in claim 14, wherein each sensor present generates an independent sensor output signal which, if it exceeds a predetermined level, a warning is triggered.

17. The safety device as claimed in claim 16, wherein the warning results in an audio and/or tactile and/or visual alert perceivable to the user being generated.

18. The safety device as claimed in claim 1, wherein each of the sections is, independent of the other sections, from 0.7 m to 5 m in length.

19. The safety device as claimed in claim 18, wherein each section, independent of the other sections, is from 0.7 m to 3 m in length.

20. The safety device as claimed in claim 1, wherein the safety device is incorporated into, or releasably attached, to a mobile structure or a permanent structure.

21. The safety device as claimed in claim 20, wherein the connection to the structure is made through a mast.

22. The safety device as claimed in claim 21, wherein the mast is telescopic and configured to be extendible from a collapsed form to an extended form and vice versa, where the collapsed form is shorter than the extended form.

23. The safety device as claimed in claim 1, wherein the connection point is configured to limit the amount a user connected to the connection point can slide along the length of the load section.

24. The safety device as claimed in claim 23, wherein the connection point does not allow said user to slide along the load section.

* * * * *